US006453630B1

(12) United States Patent
Buhrts et al.

(10) Patent No.: US 6,453,630 B1
(45) Date of Patent: Sep. 24, 2002

(54) DECK PLANK COVER

(75) Inventors: Bryan Buhrts, Reynoldsburg; Kevin Troy Burt, Columbus, both of OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 09/518,119

(22) Filed: Mar. 3, 2000

(51) Int. Cl.[7] ..... E04F 11/16

(52) U.S. Cl. ..... 52/177; 52/717.04; 52/717.05; 52/730.7; 52/738.1

(58) Field of Search ..... 52/730.7, 736.3, 52/738.1, 718.04, 717.04, 650.3, 204.53, 204.54, 211, 212, 177, 302.3, 3, 716.2, 717.03, 717.05

(56) References Cited

U.S. PATENT DOCUMENTS

| | | | | | |
|---|---|---|---|---|---|
| 4,885,882 | A | | 12/1989 | Forshee | |
| 4,907,387 | A | | 3/1990 | Turnbull | |
| 5,009,045 | A | | 4/1991 | Yoder | |
| 5,070,664 | A | * | 12/1991 | Groh | 52/177 |
| 5,326,187 | A | * | 7/1994 | St. Marie | 52/727 |
| 5,475,952 | A | * | 12/1995 | O'Connor | 52/738.1 |
| 5,553,427 | A | | 9/1996 | Andres | |
| 5,613,339 | A | * | 3/1997 | Pollock | 52/177 X |
| 5,642,592 | A | | 7/1997 | Andres | |
| 5,647,184 | A | * | 7/1997 | Davis | 52/592.1 |
| 5,713,165 | A | * | 2/1998 | Erwin | 52/738.1 |
| 5,758,467 | A | * | 6/1998 | Snear et al. | 52/177 X |
| 5,794,390 | A | * | 8/1998 | Oliveri | 52/738.1 |
| 5,836,128 | A | | 11/1998 | Groh et al. | |
| 5,881,508 | A | * | 3/1999 | Irvine et al. | 52/177 |
| 5,904,011 | A | | 5/1999 | Biro | |
| 5,913,784 | A | | 6/1999 | Hite | |
| 6,108,992 | A | * | 8/2000 | Shaw | 52/302.3 |
| 6,131,355 | A | * | 10/2000 | Groh et al. | 52/592.1 |
| 6,374,555 | B1 | * | 4/2002 | Gusler | 52/177 |
| 2002/0023395 | A1 | * | 2/2002 | Pasterchick | 52/177 |

OTHER PUBLICATIONS

TimberTech® Engineered Decking Systems, TimberTech Limited, brochure dated 1999.*

Brochure from Anchor Decking Systems, Inc., 7 pages.

World Wide Web, Patiostore.com web site, 7 pages.

Brochure from Walker–Williams Lumber Company, Deck –Cap, 6 pages.

* cited by examiner

*Primary Examiner*—Laura A. Callo
(74) *Attorney, Agent, or Firm*—Standley & Gilchrist LLP

(57) ABSTRACT

A deck plank cover made from a plastic material, such as a wood composite, wherein the deck plank cover is designed to be affixed to the top surface of a preexisting deck plank. The deck plank cover is useful for repairing or protecting mildly deteriorated or deteriorating wooden deck planks of typical wooden decks. The deck plank cover may be affixed directly to the top surface of the existing wooden deck planks, and serves to substantially protect the wooden deck planks from further exposure to the elements. The deck plank cover of the present invention may also be applied to non-deteriorated wooden deck planks to prevent the onset of deterioration and to alleviate the need for treatment of the subjacent wooden deck planks with chemical preservatives. The deck plank cover preferably simulates the look of real wood, and may be produced in various cross-sectional shapes and sizes and from a variety of plastic materials.

21 Claims, 2 Drawing Sheets

DECK PLANK COVER

BACKGROUND AND SUMMARY OF THE INVENTION

The present invention relates generally to decks, and more particularly to a deck plank cover and to a process for applying said deck plank cover to the wooden deck planks of an existing deck. The deck plank cover is made of a plastic material, preferably a wood composite that simulates the look of real wood.

A common problem exists with decks of typical wooden construction. When a deck is constructed of wood, it is subject to rotting, warping and other tendencies inherent to the wood itself. Therefore, wooden decks must generally be treated with a chemical preservative to help the wood withstand the effects of exposure to an outdoor atmosphere. Such treatment is usually very time consuming and laborious, and typically must be repeated frequently. Additionally, even with proper treatment there is no guarantee that the wood will not deteriorate. There are a number of reasons for this, including moisture present in the wood prior to treatment, areas of the wood which are difficult to access during treatment, and entry ways into the wood, such as nail holes, which allow moisture to intrude. Furthermore, the wood may also be damaged by temperature fluctuations leading to expansion and contraction, and by exposure to ultraviolet radiation via sunlight.

Once a wooden deck has begun to deteriorate there is generally little that can be done to halt the process. The typical solution is to remove and replace the wooden boards once they reach a point where their appearance can no longer be tolerated or they become unsafe. Replacement of boards is not only costly, but can also be difficult depending on the construction of the deck and the particular location of the damaged board. In addition, deteriorating boards can prove a danger, as they often produce splinters, result in an uneven walking surface, and, because the deterioration may occur from within, may be structurally unstable without appearing as such from the outside.

It would be highly desirous, therefore, to be able to cover the surface of a wooden deck, whether or not it has already begun to show signs of deterioration, whereby an aesthetically pleasing and stable surface would result and removal and replacement of deck planks could be averted. The deck plank cover of the present invention makes this desire a reality. Not only may the deck plank cover of the present invention be applied to a deck at the early stages of deterioration to prolong its life, but it may also be applied to new decks to help prevent the onset of deterioration.

The present invention contemplates a plastic deck plank cover, preferably a wood composite that simulates the look of real wood, wherein the deck plank cover may be applied individually over existing wooden deck planks. The deck plank cover may be applied using conventional wooden deck board mounting hardware, including nails and screws, or alternatively, may be affixed with glue or other suitable adhesives. Although, the deck plank cover is preferably designed to simulate the look and color of wood, it may also be painted or stained. The moisture resistant properties of the material comprising the deck plank cover eliminates the splitting, splintering, decaying, and rotting common to wooden boards, and also serves to impede moisture from reaching the underlying wooden deck planks to which the deck plank covers are attached. Additionally, because the deck plank covers are moisture resistant, they are ideal for use in areas of high moisture, such as around pools and hot tubs.

BRIEF DESCRIPTION OF THE DRAWINGS

In addition to the novel features and advantages mentioned above, other objects and advantages of the present invention will be readily apparent from the following descriptions of the drawings and preferred embodiments, wherein.

DETAILED DESCRIPTION OF THE PREFERRED EMBODIMENT(S)

Figure 1:
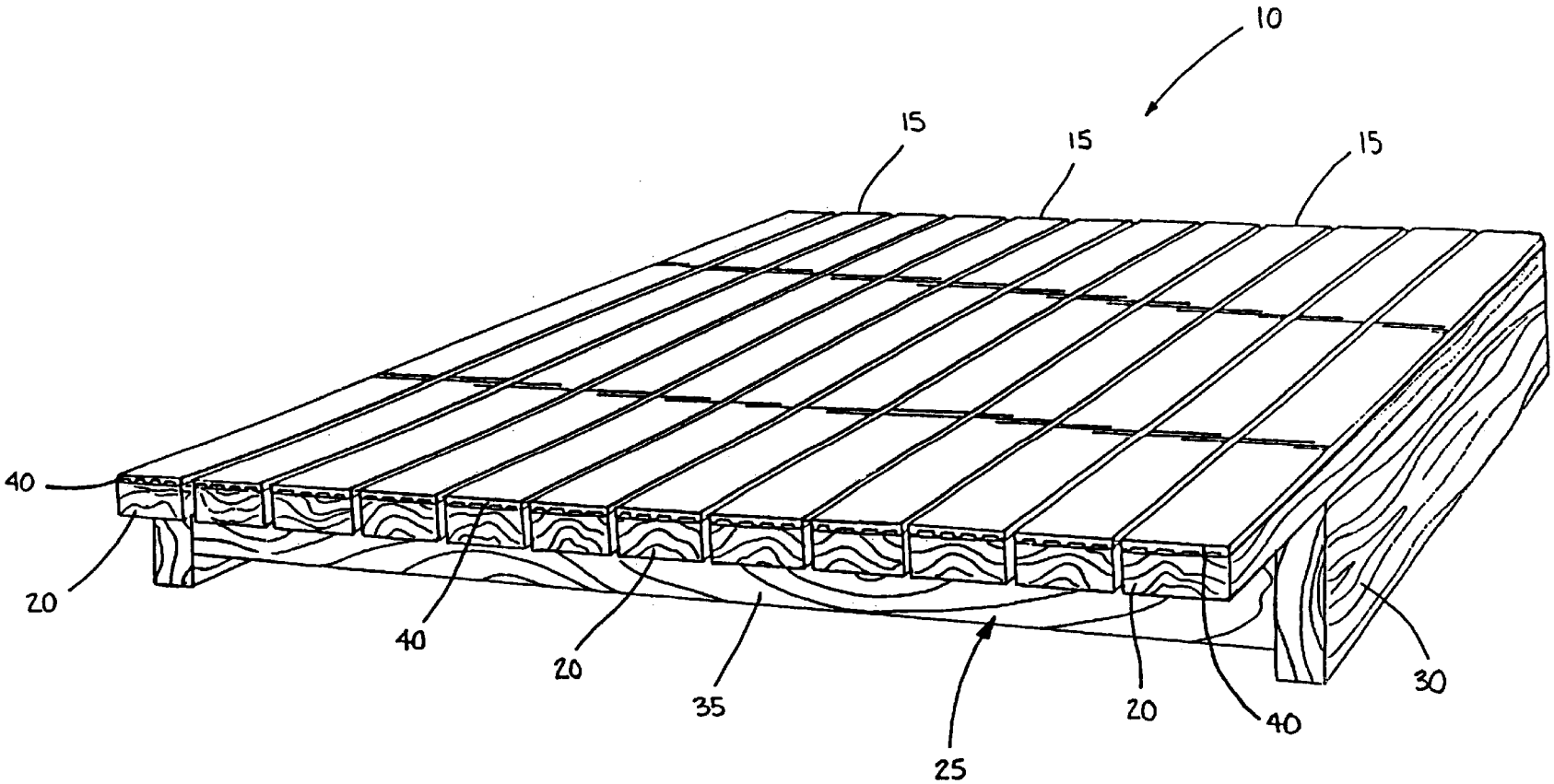
FIG. 1 is a perspective view of a preferred embodiment of the present invention installed on an existing wood deck.

The present invention pertains to a deck plank cover for mounting on top of an existing wooden deck plank. The deck plank cover is preferably made from a wood composite material, but may also be constructed of an alternative plastic material such as PVC, polyethylene, or polypropylene. Typically, the deck plank cover of the present invention is produced by extrusion, but other methods of production may be possible.

In a preferred embodiment of the invention depicted in the drawings, the deck plank cover may have a width equivalent to a standard 2×6 inch wooden board. It should be understood, however, that the deck plank cover may be designed to be equivalent to any of a number of common lumber widths, or to many other sizes and shapes without departing from the spirit and scope of the invention.

The present invention also involves a method for repairing or protecting an existing wooden deck. The method encompasses the application of individual deck plank covers to the top surface of the wooden deck planks on a pre-existing deck.

FIG. 1 shows a typical wooden deck 10 with a multitude of deck plank covers 15 attached thereto. Although in this example, the deck 10 is of wood construction, it should be understood that the deck could also be of a plastic or metal construction. The deck 10 consists of a number of wooden deck planks 20 mounted to a sub-frame. The sub-frame will typically consist of a number of ledgers 30 and joists 35, to which support legs (not shown) are attached for anchoring the sub-frame to the ground. The construction of the deck 10 is shown for purposes of illustration only, and many alternate configurations are possible.

The wooden deck planks 20 may be of many common lumber sizes, such as 2×2, 2×4, or 2×6 inches. Alternatively, the wooden deck planks may also be of a non-standard width. The deck plank covers 15 should preferably be substantially the same width as the wooden deck planks 20, to facilitate complete coverage of the top surface of the wooden deck planks by the deck plank covers. It can be seen by reference to FIG. 1 that the deck plank covers 15 are designed to run longitudinally along with the wooden deck planks 20, and to reside directly on the top surface thereof.

Figure 2:
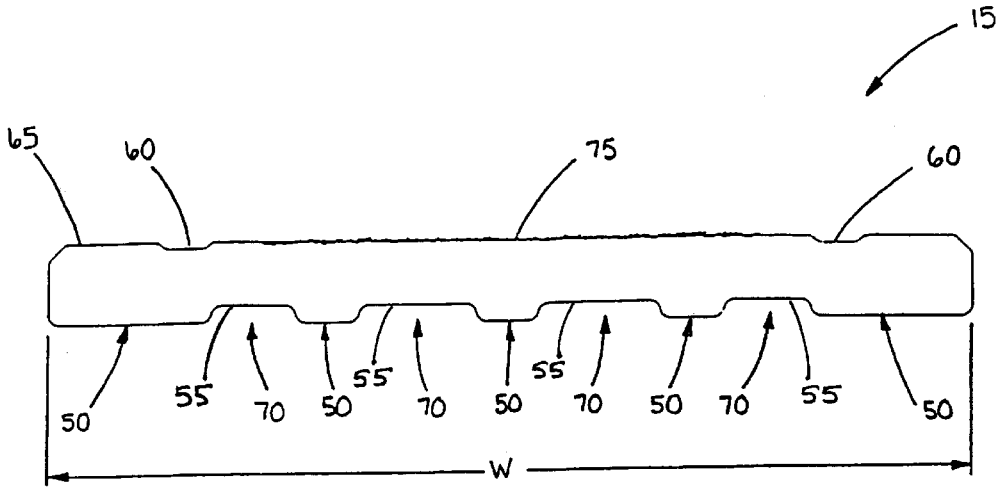
FIG. 2 is a cross-section of a preferred embodiment of the deck plank cover of the present invention.

The deck plank covers 15 may be affixed to the wooden deck planks 20 by any of the several means traditionally used in wooden deck construction, including nails and screws. Additionally, the deck plank covers 15 may be attached using an adhesive, or a combination of an adhesive and traditional mounting means. In FIG. 2, the cross-section of the deck plank cover 15 is visible as an exposed edge 40. The deck plank cover edge 40 may be covered after installation by means of a trim strip or board running transverse to the wooden deck planks 20 and deck plank covers 15.

A cross-section of a preferred embodiment of the deck plank cover 15 of the present invention can be seen by reference to FIG. 2. The deck plank cover 15 is of a specific width W. As mentioned above, the deck plank cover 15 should preferably be substantially the same width as the wooden deck plank to which it will be attached. The deck plank cover 15 may therefore be produced in various standard widths to mate to common lumber sizes. The deck plank cover 15 may also be produced in custom widths within reasonable manufacturing parameters.

Several fillets 50 can be seen protruding from the bottom 55 of the deck plank cover 15. The number of fillets 50 may vary depending on the width W of the deck plank cover 15, however, a fillet 50 should always be provided along each longitudinal edge of the deck plank cover. Preferably, the fillets 50 run the longitudinal length of the deck plank cover 15. The fillets 50 contact the top surface 65 of the wooden deck plank 20 when the deck plank cover 15 is attached thereto. The fillets 50 allow several passageways 70 to be formed between the deck plank cover 15 and the wooden deck plank 20 to which it is attached. The passageways 70 are an important feature of the present invention, as they provide an escape route for any moisture that occurs between the deck plank cover 15 and the wooden deck plank 20.

Longitudinally oriented grooves 60 are shown in the top surface 65 of the deck plank cover 15. The grooves 60 assist in creating the illusion of individual boards, and may further serve to collect and channel water to the edge of the deck plank cover 15 and off of the deck surface. Additionally, if fasteners are used to attach the deck plank cover 15 to the wooden deck plank 20, the fasteners should be installed through the grooves 60 (see FIG. 3). The grooves 60 may be of various size and location about the top surface 65 of the deck plank cover 15.

The top surface 65 of the deck plank cover 15 may employ texturing 75 at various locations. In a preferred embodiment of the present invention, the texturing 75 may run longitudinally along the length of the deck plank cover 15 and be configured to appear as wood grain. Many other textures and designs are possible, however.

Figure 3:
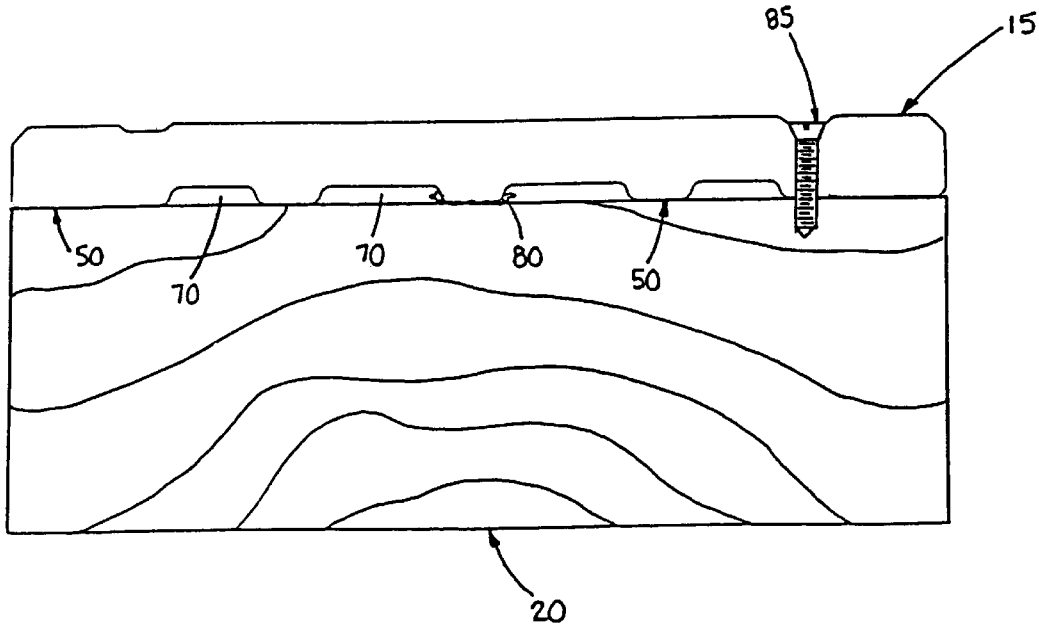
FIG. 3 is a cross-section of a preferred embodiment of the deck plank cover of the present invention installed on a wooden deck plank.

Now referring to FIG. 3, a preferred embodiment of the deck plank cover 15 of the present invention can be seen affixed to a wooden deck plank 20. The passageways 70 mentioned previously, can be seen more clearly in FIG. 3. The width W of the deck plank cover 15 can be seen to be substantially the same as that of the wooden deck plank 20. This is important for several reasons. First, in one embodiment of the present invention, it is contemplated that the deck plank cover 15 will be utilized to cover a wooden deck plank 20 which is suffering from the initial stages of deterioration due to exposure to the elements. Employing a deck plank cover 15 with a width equivalent to that of the subjacent wooden deck plank 20, helps to ensure that rain and sunlight will be unable to contact substantially all of the top surface 65 of the wooden deck plank. Therefore, a majority of the wooden deck plank 20 will be sheltered from direct exposure to the elements. Preventing further contact with the elements will aid in preventing further deterioration of the wooden deck plank.

Additionally, although in FIG. 1 the wooden deck planks 20 are shown affixed to the underlying sub-frame at spaced intervals, quite often wooden decks are constructed with no such gaps between the deck planks. Therefore, by employing a deck plank cover 15 whose longitudinal edges are aligned with the longitudinal edges of the wooden deck plank 20 to which it is attached, multiple deck plank covers may be properly abutted during installation upon the underlying abutting wooden deck planks.

For purposes of illustration only, the deck plank cover in FIG. 3 is shown attached to the wooden deck plank 20 by both a screw 85 and by adhesive 80. If screws or nails are utilized for attachment, they may be driven through the deck plank cover just as they would if a wooden deck plank were used. Although an adhesive 80 is only shown between one of the several fillets 50 and the wooden deck plank 20, adhesive would preferably be placed in more than one location on the underside of the deck plank cover 15. In addition to attachment by traditional means, the deck plank cover of the present invention may also be cut to size or shape as required.

While one aspect of the present invention is to cover a wooden deck plank 20 that has begun to deteriorate, it should be realized that a deck plank that is rotted or otherwise structurally unsound must be replaced prior to the application of the deck plank cover 15. Replacement of a rotted deck plank is required, as application of the deck plank cover 15 may not provide the extra strength needed to make the deck plank structurally sound, particularly if deterioration continues. Additionally, a rotted deck plank will likely not provide a sufficiently solid surface for receiving the mounting hardware or adhesive necessary to install the deck plank cover 15. Therefore, the deck plank cover 15 of the present invention should only be applied to deck planks that are suffering from primarily visual deterioration, such as fading, cracking, or splintering, for example.

As discussed above, in the preferred embodiment of the present invention the deck plank cover is constructed from a plastic material. Various embodiments of a plastic deck plank cover are possible. In one preferred embodiment, the deck plank cover 15 is extruded from a wood replacement material. The wood replacement material may be a polymer, such as homopolymers and copolymers of polyvinyl chloride (PVC), high density polyethylene (HDPE), polypropylene (PP), or a mixture of these polymers. The wood replacement material preferably includes cellulose material to help create the appearance of real wood. The cellulose material may be in the form of cellulose fibers (e.g., wood flour and the like). A suitable wood replacement material composition and method are described in U.S. Pat. No. 5,516,472 entitled EXTRUDED SYNTHETIC WOOD COMPOSITION AND METHOD FOR MAKING SAME, which is hereby incorporated by reference herein. The deck plank cover 15 of the present invention may also be comprised of other thermoplastics such as pure polyvinyl chloride (including foamed PVC), polyethylene, polypropylene or similar plastics with suitable properties.

Although the deck plank 15 of the present invention has been generally described above as applied to a wooden deck in a mildly deteriorated condition, such does not have to be the case. The deck plank cover 15 of the present invention may also be applied to decks with wooden deck planks in good condition. Utilization of deck plank covers on newer wooden decks may serve to alleviate the need for the repeated application of chemical preservatives, such as stains and paints, and may retard the deterioration of the underlying deck planks by minimizing exposure to the elements.

Furthermore, it should be understood that the deck plank cover of the present invention may be produced in a variety of cross-sectional shapes and sizes in any of the materials mentioned above, and nothing in the foregoing description of the preferred embodiments should be construed to limit the deck plank cover of the present invention to any particular cross-sectional shape or size.

The scope of the invention is not to be considered limited by the above disclosure, and modifications are possible without departing from the spirit of the invention as evidenced by the following claims.

What is claimed is:

1. A deck plank cover attached to a top surface of an existing deck plank, said deck plank cover comprising:

a generally rectangular plank made from a plastic material and having a horizontal top and bottom surface and two sides; and at least two longitudinally oriented fillets protruding from said bottom surface;

wherein said sides of said deck plank cover are substantially aligned with the corresponding sides of said existing deck plank;

wherein a bottom surface of each of said at least two longitudinally oriented fillets resides substantially against said top surface of said existing deck plank; and wherein each fillet's width is greater than its height.

2. The deck plank cover of claim 1, wherein said plastic material is a wood composite.

3. The deck plank cover of claim 1, wherein said plastic material is polyethylene.

4. The deck plank cover of claim 1, wherein said plastic material is polyvinyl chloride.

5. The deck plank cover of claim 1, wherein said plastic material is polypropylene.

6. The deck plank cover of claim 1, wherein said deck plank cover is co-extruded from more than one plastic material.

7. The deck plank cover of claim 1, further comprising at least one longitudinally oriented groove along said top surface of said deck plank cover.

8. The deck plank cover of claim 1, further comprising a texture on at least a portion of said top surface of said deck plank cover.

9. The deck plank cover of claim 8, wherein said texture simulates the look of wood grain.

10. The deck plank cover of claim 8, wherein said texture has the purpose of increasing the coefficient of friction of said top surface of said deck plank cover.

11. The deck plank cover of claim 1, further comprising at least one channel along said bottom surface thereof, said at least one channel formed by said at least two longitudinally oriented fillets and said bottom surface of said deck plank cover, said channel adapted to allow moisture to escape therethrough.

12. A deck plank cover attached to a top surface of an existing deck plank, comprising:

a generally rectangular plank made from a plastic material and having a horizontal top and bottom surface and two sides;

at least two longitudinally oriented fillets protruding from said bottom surface, an outer edge of said fillets aligned with a corresponding side of said plank; and at least one longitudinally oriented groove along said top surface of said plank;

wherein said at least two longitudinally oriented fillets create at least one channel along said bottom surface of said plank, said channel adapted to allow moisture to escape therethrough;

wherein each side of said deck plank cover is substantially aligned with a corresponding side of said existing deck plank;

wherein a bottom surface of each of said at least two longitudinally oriented fillets resides substantially against said top surface of said existing deck plank; and wherein each fillet's width is greater than its height.

13. The deck plank cover of claim 12, wherein said plastic material is a wood composite material.

14. The deck plank cover of claim 12, wherein said plastic material is polyethylene.

15. The deck plank cover of claim 12, wherein said plastic material is polyvinyl chloride.

16. The deck plank cover of claim 12, wherein said plastic material is polypropylene.

17. The deck plank cover of claim 12, wherein said deck plank cover is co-extruded from more than one plastic material.

18. The deck plank cover of claim 12, further comprising a texture on at least a portion of said top surface of said deck plank cover.

19. The deck plank cover of claim 18, wherein said texture simulates the look of wood grain.

20. The deck plank cover of claim 18, wherein said texture has the purpose of increasing the coefficient of friction of said top surface of said deck plank cover.

21. The deck plank cover of claim 12, wherein said sides of said deck plank cover are substantially aligned with the sides of said existing deck plank.

* * * * *